United States Patent [19]

Den Bleyker

[11] Patent Number: 4,902,303

[45] Date of Patent: Feb. 20, 1990

[54] SEPARABLE QUENCH RING AND DISTRIBUTION CHANNEL FOR A GASIFICATION REACTOR

[75] Inventor: Alfred L. Den Bleyker, Houston, Tex.

[73] Assignee: Texaco Inc., White Plains, N.Y.

[21] Appl. No.: 269,325

[22] Filed: Nov. 10, 1988

[51] Int. Cl.[4] ..... C10J 3/82

[52] U.S. Cl. ..... 48/69; 48/87; 261/112.1; 261/121.1

[58] Field of Search ..... 48/69, 87, DIG. 2; 55/223, 241, 244, 256; 261/112.1, 121.1, 17; 422/207

[56] References Cited

U.S. PATENT DOCUMENTS 4,192,654 3/1980 Brooks ..... 48/87

4,444,726 4/1984 Crothy, Jr. et al. ..... 422/207

*Primary Examiner*—Joye L. Woodard

*Attorney, Agent, or Firm*—Robert A. Kulason; James J. O'Loughlin; Robert B. Burns

[57] ABSTRACT

A gasification reactor which includes a shell, having a combustion chamber in which a carbonaceous fuel mix is burned to produce a hot gaseous effluent. A quench chamber within the shell includes a water bath in which the hot effluent is cooled. A refractory lined constricted throat directs hot effluent into a dip tube which guides the effluent into the bath. A multi-segment quench ring supports the refractory throat, and is communicated with a coolant distributing manifold. A discharge port is provided in the quench ring to impinge liquid coolant against the dip tube guide surface. A multi-segment distribution ring segment is removably independent of the quench ring main segment to facilitate separation of the manifold from the quench ring, without removing support to the refractory throat.

6 Claims, 2 Drawing Sheets

SEPARABLE QUENCH RING AND DISTRIBUTION CHANNEL FOR A GASIFICATION REACTOR

BACKGROUND OF THE INVENTION

In the production of a usable synthesis gas by the combustion of a carbonaceous fuel, the process is operated most effectively in a gasifier or reactor under high temperature and high pressure conditions. For example, for the production of a gas from a particulated coal or coke, a preferred operating temperature range of about 2400° to 2600° F. is maintained, at a pressure of between about 5 to 250 atmospheres.

The harsh operating conditions prevalent in such a method, and in particular the wide temperature variations experienced, imposes a severe strain on many segments of the gasifier or reactor unit.

The present invention is addressed to an improvement in the structure of a gasifier, and particularly in the gasifier's quench ring and water distribution manifold. The latter by its inherent function, is exposed to maximum temperature conditions and destructive gases. This occurs by virtue of the hot synthesis gas which comes in direct contact with the quench ring and manifold as the hot effluent passes from the combustion chamber, into a cooling zone or quenching zone.

U.S. Pat. No. 4,444,726 illustrates a quench ring arrangement embodying a separable, two segment design. A sealing gasket compressed between the respective segments, maintains the latter in a relatively seal tight relationship. The sealing gasket, however, is exposed to hot effluent gas and is subject to wide temperature variations. These are factors which will limit the gasket's usable life as an effective sealant member.

In the usual reactor structure, the combustion chamber within the reactor shell is lined with a refractory material to avoid thermal damage to the shell. This refractory material can take the form of individual bricks or can be in the configuration of a unitary member shaped of a castable refractory material. In either instance, the refractory blocks or members are combined and shaped to define the gasifier's constricted throat.

The refractory throat members are normally supported in such a manner that they can be removed if required for repair or replacement. One form of support resides in placing the quench ring in a position that it will support the throat. Thus, the quench ring, which is positioned by the shell wall, will locate the supported throat. During a shut down period, however, it is more than likely that in the course of a normal cooling period, metallic segments of the gasifier such as the quench ring and its ancillary parts will cool rapidly. This allows quick access to the reactor interior parts for performing necessary repair or maintenance work.

Where the reactor's quench ring requires removal for repair or replacement, it is necessary to first detach the refractory blocks which make up the constricted throat. These non-metallic members take a much longer period of time to cool down than does the metallic quench ring. It can therefore be several days before one can obtain safe access to the reactor interior to permit removal of the quench ring. Furthermore, removal of the throat refractory necessitates the expense of its replacement because used fire brick once disturbed, cannot be reassembled correctly (due to distortions and slag accumulations that develop while in service).

Toward overcoming this problem of unnecessary gasifier down time and throat refractory replacement, the present invention embodies a gasifier structure wherein the constricted throat between the combustion chamber and the quench chamber, is formed of one or more refractory blocks. The latter are supported in place by a segmented quench ring having a separable manifold section. Thus, when the exposed manifold section of the quench ring becomes damaged due to thermal stresses or the like, the damaged part can be readily removed without disturbing the quench ring which remains in place supporting the throat.

The water carrying manifold section which maintains a coolant stream against the reactor's dip tube, is detachably fixed to the water conducting quench ring. In a preferred construction, the respective manifold and quench ring, are provided with a thermally resistant gasket compressed between mating surfaces to minimize the flow of heat therebetween. Thus, the refractory member or members which define the constricted throat need not be disturbed when the manifold is removed. Further, the thermally resistant gasket between the mating or engaged members minimizes heat transfer therebetween.

In terms of economics, a reactor's shut down period for repair purposes, can be reduced by several days as a result of use of the disclosed separable quench ring structure. It has been determined for comparison purposes, that a typical gasification reactor can be accessed for internal repair to the quench ring, within two days when the instant quench ring is a part of the unit. If the refractory neck has to be removed to allow access to the quench ring, the total time required for refractory cooling and refractory replacement upon a new quench ring could be five days or more.

It is an object of the invention therefore, to provide a novel quench ring assembly for a gasification reactor, which facilitates removal and repair of the reactor's internal elements.

A further object is to provide a segmented quench ring which is fabricated to permit ready access to a reactor's damaged internal parts.

Another object is to provide a multi-segmented quench ring for a gasification reactor, which can be disassembled and removed piecemeal from the refractory's interior.

DESCRIPTION OF THE DRAWINGS

Referring to FIG. 1, a gasifier or reactor 10 of the type contemplated embodies an elongated metallic steel walled shell 11. The reactor is normally operated in an upright position to permit a downflowing of the hot product. Shell 11 includes a reaction or combustion chamber 12 at the upper end. To withstand operating temperatures between 2,000° to 3,000° F., chamber 12 is provided with a lined inner wall 13, preferably formed of a suitable refractory material.

Figure 1:
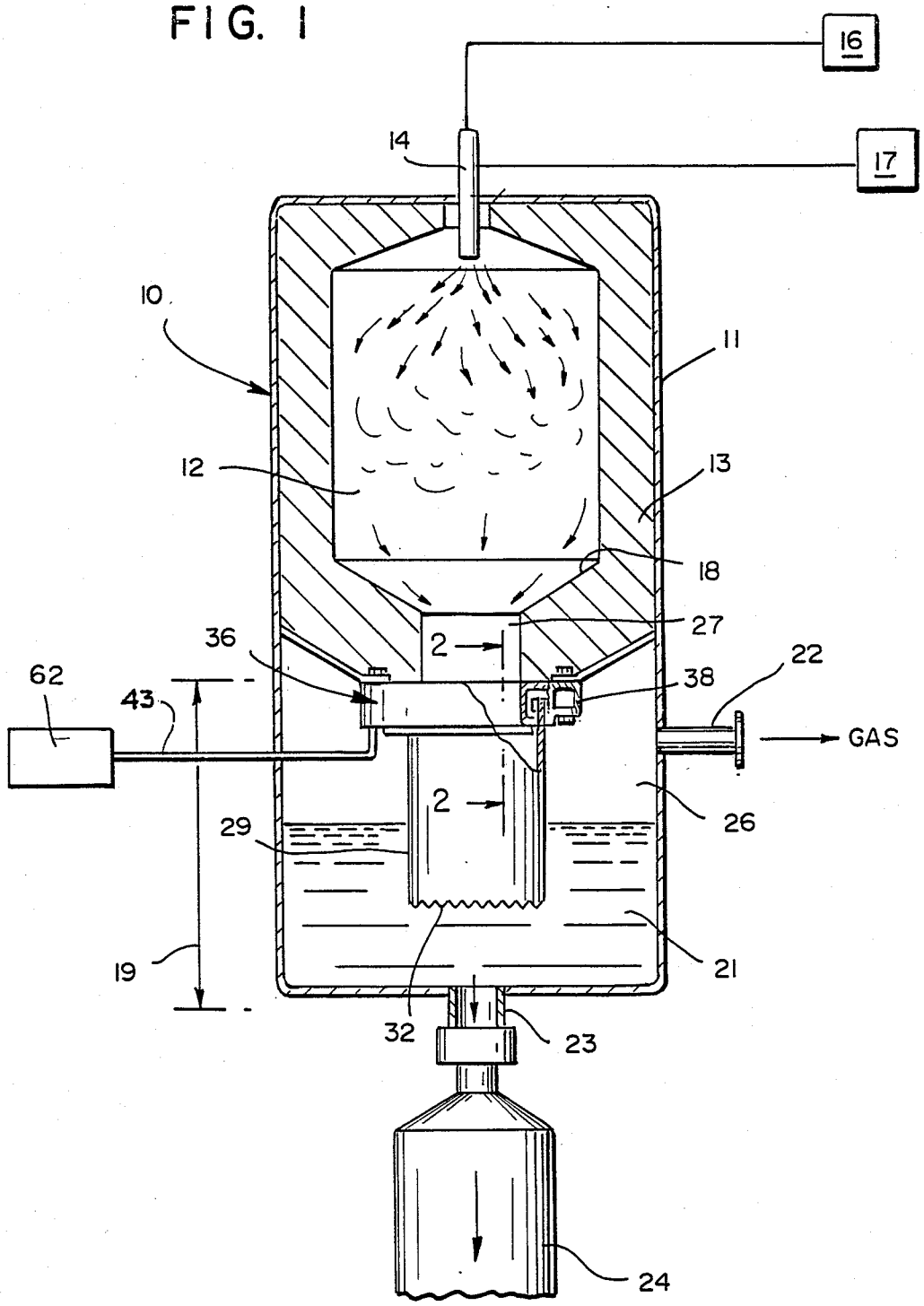
FIG. 1 is an elevation view in cross-section of a reactor of the type contemplated.

A burner 14 is removably positioned at shell 11 upper wall to inject the carbonaceous fuel mixture such as particulated coal or coke from source 16, into reaction chamber 12. An amount of a combustion supporting gas from a pressurized source 17 is concurrently fed into burner 14 to form a desired fuel mixture.

The invention can be applied equally as well to gasifiers which burn a variety of carbonaceous solid, liquid, or gaseous fuels. To illustrate the instant embodiment, however, it will be assumed that burner 14 is communicated with a source 16 of coke. The latter is preferably preground and formed into a slurry of desired consistency by addition of a sufficient amount of water. The pressurized combustion supporting gas at source 17 is normally oxygen, air, or a mixture thereof.

The lower end of reaction chamber 12 is defined by a downwardly sloping refractory floor 18. This configuration enhances the discharge of hot gas and liquefied slag from the reaction chamber 12.

The lower end of shell 11 includes a quench chamber 19 into which the products of gasification are directed. Here, both solid and gaseous products contact liquid coolant bath 21, which is most conveniently comprised of water. The cooled gas emerges from quench bath 21 into disengaging zone 26 before leaving the quench chamber through line 22. Cooled, substantially particle free gas can now be processed in downstream equipment and operations into a usable form. The solid or slag component of the effluent sinks through bath 21 to be removed by way of discharge port 23 into lockhopper 24.

Reaction chamber 12 and quench chamber 19 are communicated through constricted throat 27 formed in the reaction chamber floor 18. To achieve efficient contact of the hot effluent which leaves reaction chamber 12, with liquid in bath 21, quench chamber 19 is provided with a dip tube 29 having an upper edge positioned adjacent to constricted throat 27. Dip tube 29 further includes a lower edge 32 which terminates in the coolant bath 21 thereby defining an effluent path.

Figure 2:
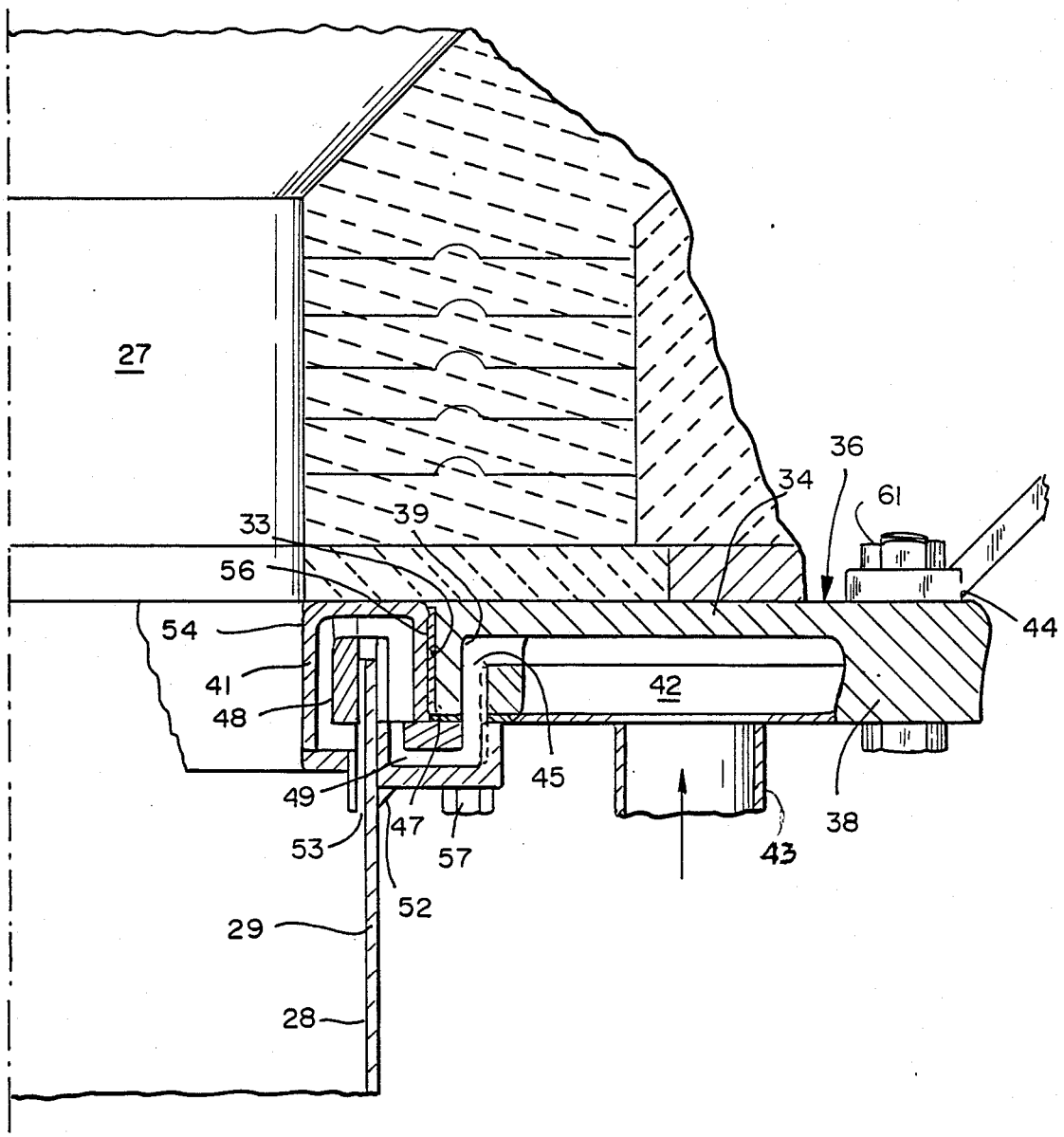
FIG. 2 is a cross-sectional view taken along line 2—2 of FIG. 1.

Referring to FIG. 2, constricted throat 27 defines the initial guide passage through which the high temperature, high pressure effluent passes. Functionally, inner wall 28 of dip tube 29 defines a cylindrical guide path for hot effluent including both the gaseous and solid components as they flow from throat 27 into water bath 21.

Beneficially, the inner wall or guide surface 28 of the cylindrical dip tube 29, is wetted by directing one or more pressurized streams of water thereagainst from quench ring assembly 36.

The latter is supported in place by brackets 44 which depend from the inner wall of shell 11. Quench ring assembly 36 is comprised primarily of two cooperating ring segments 34 and 41. The latter are separably joined into a liquid sealing relationship by gasket 56 compressed therebetween.

More particularly, the multi-segment quench ring assembly 36 is comprised of a first or main segment 34 which takes the form of a toroidal ring or body having a side wall 38 which defines an outer periphery. A second or inner wall 39 forms a sealing or engaging surface to which the quench ring second segment 41 (also called the distribution manifold) is fastened.

First segment 34 includes a liquid circulating chamber or passage, 42 communicated at its lower side with a pressurized source 62 of the cooling liquid, preferably water. Water is pumped under pressure into the liquid circulating chamber 42 by way of one or more risers 43.

The upper wall of quench ring segment 34 is supportably engaged as noted by one or more stiffener rings or brackets 44, together with a plurality of peripherally spaced fastening bolts 61. Stiffener ring 44 firmly anchors the toroidal shaped quench ring assembly 36 such that it forms a circular shelf or lower support means for the refractory which makes up the constricted throat 27 and floor 18.

Quench ring first segment 34 further includes an inner rim 33 which defines a cylindrical internal recess or recessed receptacle. Preferably, said recessed receptacle is substantially cylindrical in configuration or it can be flared outwardly in a downward direction to facilitate registry of a corresponding mating surface of second toroidal ring segment 41.

The lower surface of segment 34 is provided with a plurality of transfer passages 45 which conduct water from chamber 42. Said lower surface is contoured to form a flat, liquid tight seal with the corresponding face of ring segment 41. An outwardly extending flange or lip 47 of said ring segment 41, compressibly engages a corresponding surface at the underside of segment 34 to complete their desired liquid tight seal.

Segment 41 includes a toroidal body into which an annular channel 48 is formed. Said channel communicates with cross-passages 49, which are communicated in turn with water chamber 42 through connecting passages 45.

Second quench ring segment 41 further includes an interior wall which connects with the upper end of dip tube 29. The latter is fastened in place at a peripheral weld 52 to support the dip tube in aligned relation with constricted throat 27.

The outer edge of second ring segment 41 is formed with a diameter less than the diameter of the recessed receptacle. Thus, the two complementary surfaces can be assembled into substantially tight, sealing relationship by lifting segment 41 up into said receptacle.

Operationally, annular channel 48 receives a pressurized stream of water from chamber 42. Said second segment 41 is provided with a discharge port 53 through which pressurized streams of water are ejected onto the exposed face or inner wall 28 of dip tube 29. Thus, downwardly flowing hot effluent from throat 27, will contact and be initially guided by the outer face 54 of second segment 41. The effluent will thereafter contact dip tube inner wall 28 so that the effluent stream is effectively led downwardly into water bath 21 (Fig. 1).

Compressible gasket 56 functions as a liquid seal between hot effluent gas descending through constricted throat 27, and cooled gas disengaging zone 26. As fastening bolts 57 are tightened into the wall of second segment 41, pressurized coolant flow will pass through both the quench ring 36 connected segments until the water is discharged onto inner wall 28 of dip tube 29.

Compressed gasket 56 between the engaging surfaces of members 36 and 41 can be formed of a durable, inert, yet temperature resistant material such as asbestos or asbestos substitutes. Preferably, gasket 56 is shaped to conform to both the inner face, and along the bottom mating surfaes of the respective quench ring members 34 and 41. As a practical matter, the vertical component of gasket 56 is comprised of a soft or fluid refractory such as "TEFLON". The lower or horizontal portion of gasket 56 can be asbestos.

As second or manifold member 41 is drawn into liquid tight engagement with the first segment 36 by way of bolts 57, the quench ring as a unit will maintain its water tight integrity. For the most efficient fastening arrangement, the separable quench ring members are bolted along a common interface with a plurality of the peripherally spaced bolts 57.

The disclosed multi-segment quench ring affords a dual advantage to both the reactor structure and to its mode of operation. The disconnectable nature of the quench ring allows the second segment 41 to be readily removed from the reactor without disturbing the main quench ring segment 34. This further permits removal of segment 41, which is most susceptible to thermal damage, without concern for the refractory which is supported by the remainder of the quench ring.

It is understood that although modifications and variations of the invention can be made without departing from the spirit and scope thereof, only such limitations should be imposed as are indicated in the appended claims.

I claim:

1. In a gasification reactor (10) for combusting a carbonaceous fuel mixture to produce a hot effluent stream comprised primarily of a usable gas, said reactor including:

a reactor shell (11), a refractory lined combustion chamber (12) in said shell, a burner (14) extending through said shell into the combustion chamber and communicated to a means for supplying a pressurized carbonaceous fuel mixture, for discharging a flow of the fuel mixture into the combustion chamber, whereby to combust the mixture and form a said hot effluent stream, means in said shell forming a quench chamber (26) including a liquid bath (21) beneath said combustion chamber (12), means forming a constricted throat (27) in said shell interconnecting the combustion chamber (12) to said quench chamber (26) for conducting said hot effluent stream, from the combustion chamber to the quench chamber, a dip tube (29) positioned in said shell (11) defining an effluent guide passage, said dip tube having an inlet positioned adjacent to said constricted throat (27) for guiding said hot effluent stream from said combustion chamber into the liquid bath 21, of the quunch chamber, the improvement therein of a multi-segment quench ring assembly (36) depending from said shell and positioned in alignment with said constricted throat to receive the hot effluent stream therefrom, including;

a first toroidal ring segment (34) having an annular coolant passage (42) connected to a pressurized liquid supply means, and having an internal rim (33) defining a recessed receptacle, (41)

a second ring segment removably registered in said recessed receptacle, (41) having an internal manifold channel (48) in fluid communication with said annular coolant passage (42) and having at least one means forming a discharge port (53) in liquid communication with said internal manifold channel (48) and directed onto said dip tube and fastening means (57) removably registering said second ring segment in the recessed receptacle (41) of said first toroidal ring segment.

2. In the apparatus as defined in claim 1, including a thermally resistant gasket (56) compressed in said recessed receptacle, between the respective first and second ring segments.

3. In the apparatus as defined in claim 2, wherein said thermally resistant gasket (56) is formed of an asbestos composition.

4. In the apparatus as defined in claim 1, wherein said second ring segment (41) is slidably registered within said recessed receptacle.

5. In the apparatus as defined in claim 1, wherein said dip tube (29) supportably depends from said second ring segment.

6. In the apparatus as defined in claim 1, wherein said internal rim (33) defining said recessed receptacle is substantially cylindrical in shape.

* * * * *